United States Patent [19]

Butenschön

[11] Patent Number: 4,555,040

[45] Date of Patent: Nov. 26, 1985

[54] GLASS WITH STEM, PARTICULARLY A WINE GLASS

[75] Inventor: Rolf Butenschön, Hamburg, Fed. Rep. of Germany

[73] Assignee: GIVAG Gastro-Installationen-Vertrieb (Deutschland) GmbH, Hamburg, Fed. Rep. of Germany

[21] Appl. No.: 647,434

[22] Filed: Sep. 5, 1984

[30] Foreign Application Priority Data

Sep. 5, 1983 [DE] Fed. Rep. of Germany ..... 3332012

[51] Int. Cl.[4] ..... B65D 23/16

[52] U.S. Cl. ..... 215/365; 215/99.5; 215/366; 374/141

[58] Field of Search ..... 215/366, 365, 11 A, 215/99.5; 374/141, 150, 157

[56] References Cited

U.S. PATENT DOCUMENTS 1,921,348 8/1933 Cullen ..... 215/99.5

3,608,766 9/1971 D'Orefice ..... 215/99.5

FOREIGN PATENT DOCUMENTS 11968 of 1885 United Kingdom ..... 215/11 A

*Primary Examiner*—Donald F. Norton

*Attorney, Agent, or Firm*—Staas & Halsey

[57] ABSTRACT

A receptacle for holding liquid includes a temperature measuring device to measure the temperature of the liquid contained therein. The receptacle may be a stemmed wine glass which includes a thermometer in the stem. The thermometer has a bulb with a tip adjacent to or extending into the bowl of the wine glass. Thus, the temperature of the contents of the wine glass may be easily measured to establish whether the wine has been stored and poured at the correct temperature.

4 Claims, 3 Drawing Figures

GLASS WITH STEM, PARTICULARLY A WINE GLASS

BACKGROUND OF THE INVENTION

The invention relates to a glass with a stem, particularly a wine glass.

Wine connoisseurs know that good wine must be stored and drunk at specific temperatures. The best temperature for drinking the wine depends to a considerable degree on the type of wine, i.e., white wine should be drunk a lower temperature than red wine. Cooling devices have already been proposed, which not only keep the wine at the correct temperature, but also maintain the other conditions necessary, such as humidity, etc., in order to ensure completely satisfactory storage. However, a patron of a restaurant is unable to check whether or not the correct temperature has been maintained.

SUMMARY OF THE INVENTION

An object of the present invention is therefore to provide a glass with a stem, particularly a wine glass, which enables the wine drinker to precisely determine the temperature of the poured wine.

The above-mentioned object is attained by a receptacle equipped with a temperature measuring device which is positioned in such a way that the temperature of liquid contained in the receptacle can be measured. Thus, it is possible to accurately and not subjectively determine the temperature. This not only gives a wine drinker the ability to make a precise determination of temperature, but also gives an important feeling necessary for the enjoyment of wine; that one is tasting or drinking the wine at the proper temperature.

These objects, together with other objects and advantages which will be subsequently apparent, reside in the details of the construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
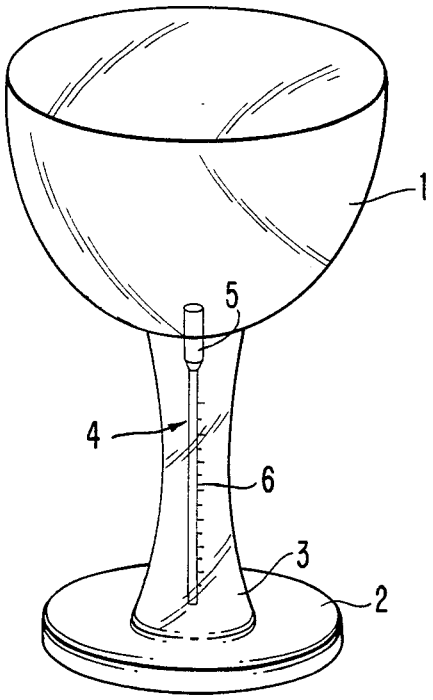
FIG. 1 is a perspective view a wine glass according to an embodiment of the present invention.

According to the present invention, a receptacle, such as a wine glass, has a bowl 1 supported by a base 2 and a stem 3. The stem 3 includes a temperature measuring device or thermometer 4 which is arranged so that a bulb 5 containing measuring fluid is located in the vicinity of the bowl 1. A calibrated capillary tube 6 extends along the stem 3.

Figure 2A:
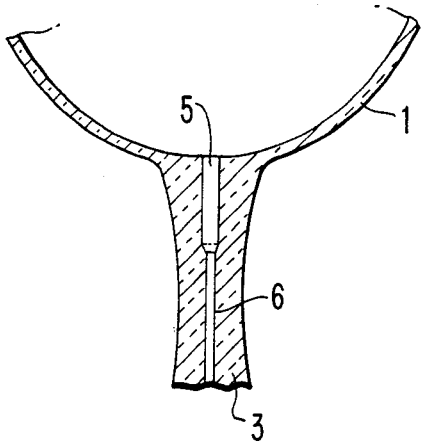
FIGS. 2A and 2B are cross-sectional views of a wine glass according to first and second embodiments of the present invention.
Figure 2B:
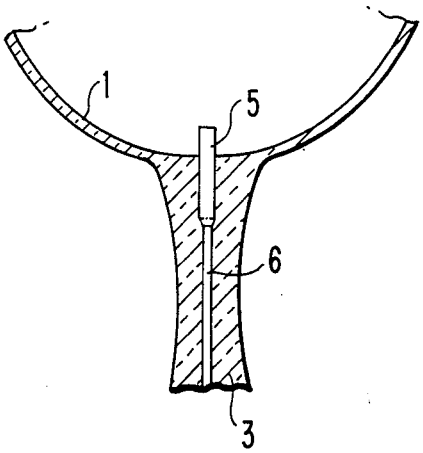

Many modifications are obviously possible in this invention. For example, wine glasses come in many different shapes and sizes and this invention could be applied to virtually all wine glasses. In addition, the placement of the thermometer bulb 5 can be varied so that it extends to greater or lesser extent into the bowl 1. FIGS. 2A and 2B illustrate two different embodiments of the present invention which differ by the amount which the bulb 5 extends into the bowl 1.

The present invention may also be modified by the type of thermometer which is used. In addition to thermometers which include capillary tubes, such as mercury and alcohol thermometers, the temperature may be displayed by a dial or digital readout. In addition, temperature sensitive crystals which vary their color depending on temperature, may be embedded in the wall of the bowl to indicate the temperature of the liquid in the bowl.

The features and advantages of the present invention are apparent from the detailed specification, and thus it is intended by the appended claims to cover all such features and advantages of the receptacle which fall within the true spirit and scope of the invention. Further, since numerous modifications and changes will readily occur to those skilled in the art, it is not desired to limit the invention to the exact construction and operation iillustrated and described, accordingly, all suitable modifications and equivalents may be resorted to, falling within the scope and spirit of the invention.

What is claimed is:

1. A receptacle for holding a liquid, comprising:

a bowl for holding the liquid;

a stem attached to said bowl; and a thermometer having a bulb located in the proximity of said bowl and a calibrated capillary tube extending along said stem.

2. A receptacle as recited in claim 1, wherein said bulb has a tip located adjacent to said bowl.

3. A receptacle as recited in claim 1, wherein said bulb extends into said bowl.

4. A receptable as recited in claim 1, wherein said bowl and stem are made of glass and said thermometer is molded in said stem.

* * * * *